US006929259B2

(12) United States Patent
Abe et al.

(10) Patent No.: US 6,929,259 B2
(45) Date of Patent: Aug. 16, 2005

(54) COMPACT BANK NOTE DISPENSING DEVICE TO PREVENT DUPLICATION RELEASES

(75) Inventors: Hiroshi Abe, Iwatsuki (JP); Joji Iida, Hachiouji (JP)

(73) Assignee: Asahi Seiko Co., Ltd., Tokyo (JP)

( * ) Notice: Subject to any disclaimer, the term of this patent is extended or adjusted under 35 U.S.C. 154(b) by 204 days.

(21) Appl. No.: 10/271,304

(22) Filed: Oct. 15, 2002

(65) Prior Publication Data

US 2003/0080494 A1 May 1, 2003

(30) Foreign Application Priority Data

Oct. 16, 2001 (JP) ..... 2001-318226

(51) Int. Cl.[7] ..... B65H 3/52
(52) U.S. Cl. ..... 271/121; 271/124; 271/35
(58) Field of Search ..... 271/121, 124, 271/35, 138, 125

(56) References Cited

U.S. PATENT DOCUMENTS 4,020,972 A 5/1977 Lundblad
4,178,113 A * 12/1979 Beaver et al. ..... 406/10
4,858,907 A * 8/1989 Eisner et al. ..... 271/124
5,370,379 A * 12/1994 Wyer ..... 271/3.03
5,443,346 A * 8/1995 Murata et al. ..... 414/222.13
6,098,837 A 8/2000 Izawa et al.
6,149,367 A * 11/2000 Begin ..... 414/331.18
6,158,733 A * 12/2000 Muraki ..... 271/127
6,203,582 B1 * 3/2001 Berner et al. ..... 29/25.01
6,247,693 B1 * 6/2001 Kawano ..... 271/3.05
6,263,258 B1 * 7/2001 Dabrowski ..... 700/231
6,325,242 B1 12/2001 Izawa et al.
6,412,770 B1 * 7/2002 Demmeler ..... 271/94
6,440,178 B2 * 8/2002 Berner et al. ..... 29/25.01

FOREIGN PATENT DOCUMENTS

JP 2001-67527 3/2001

* cited by examiner

*Primary Examiner*—Eileen D. Lillis
*Assistant Examiner*—Rashmi Sharma

(57) ABSTRACT

A duplicate let off prevention device for sheets includes a first exit guide, a second exit guide which is spaced from the first exit guide at a distance that is larger than the thickness of one sheet and is smaller than the thickness of two sheets, and a pre-exit guide which is movably located adjacent a sheet storing device. Stacked sheets are segregated in a wedge-like configuration as they contact the respective guides. A stopper can stop the sheets when the pre-exit guide moves. The pre-exit guide is biased to exert a force to assist in the segregation of the sheets.

10 Claims, 5 Drawing Sheets

-- Prior Art --

COMPACT BANK NOTE DISPENSING DEVICE TO PREVENT DUPLICATION RELEASES

BACKGROUND OF THE INVENTION

1. Field of the Invention

The present invention relates to a compact bank note dispensing device that can assist in eliminating an erroneous duplication of the release of bank notes from a stack of bank notes. More specifically, the present invention provides a novel mechanical structure that limits dispensing of a bank note or sheet by effectively sorting and aligning the lowermost sheets to predispose them for one-by-one dispensing.

2. Description of the Related Art

Bank note dispensing devices for vending machines, ATM machines, gaming machines and other devices are known in the art. Japanese Laid Open Patent Application 2001-67527 represents one example and the schematic form of that disclosure is set forth in FIG. 5. As shown in FIG. 5, a guide structure 101 has a step-like configuration adjacent a feed roller 102 and a gate roller 103. The surface configuration of the guide 101 has a slanting surface 105 which is directed downward and towards the sheet transporting direction. The guide 101 is further spaced away from a transporting track 104 by a distance of approximately the thickness of a few sheets. When the bank notes are transported to the feed roller 102 and the gate roller 103 by the action of the kick roller 106, an upper bank note 109 in the stack of bank notes can be also transported with the lowest bank note 108 when it has contact with the kick roller 106. A large portion of the moved or transported bank notes, however, are stopped by the wall 107 and also are further stopped by the slanting surface 105. Thus, theoretically, only the bank note that has contact with the kick roller 106 will pass through and be let off by the feed roller 102 and the gate roller 103.

The utilization of the slanting surface in this arrangement requires two parallel sections to extend horizontally along with the slanting surface. Combining the two parallel sections with the feed roller and the gate roller located at the bank note exit position requires additional size for such a bank note dispensing device. Additionally, the feed roller and the gate roller must be located at this parallel section which increases the cost.

Thus, while there have been numerous attempts to address the problem of accurately dispensing a bank note on a one-by-one basis, the prior art is still seeking an efficient and economical solution to this problem.

SUMMARY OF THE INVENTION

The present invention is directed to providing a compact bank note or sheet dispensing device that can address the problem of duplicate dispensing of bank notes or sheets, while providing a relatively economical and easily manufactured configuration.

The present invention utilizes a duplicate let off prevention device for sheets, which includes a first exit guide for supporting a lowermost sheet to be let off from a stack of sheets and a second exit guide which is positioned above the first exit guide by a distance that is larger than the thickness of one sheet, but is smaller than the thickness of two sheets. A pre-exit guide is located adjacent the stack of sheets and is biased to a first position at a distance above the exit guide greater than the distance between the first exit guide and the second exit guide. The pre-exit guide can assist in providing a preliminary sorting or segregating of a portion of the lowermost sheets, while a stopper member positioned adjacent the pre-exit guide assists in stopping the upper sheets during any traverse movement of the pre-exit guide.

In such a structure, the sheets can be let off from the storing section by a let off device and can travel between the first exit guide and the pre-exit guide. The lower most sheet can have contact with the let off device so that it is transported towards the side of an exit aperture. Sheets, for example bank notes, which are above and have contact with the lower bank note, can also be transported in the same direction as a result of friction contact. As a result, several bank notes will travel between the first exit guide and the pre-exit guide and will be stopped by the pre-exit guide and the second exit guide. As a result, only the lower most sheet, which has contact with the let off device will eventually pass between the first exit guide and the second exit guide and be appropriately dispensed outside of the storing section, for example, of a safe unit.

When the upper sheets are positioned between the first exit guide and the second exit guide and are held for further movement, the pre-exit guide can be moved traverse to the surface of the first exit guide by the resulting force of the sheets. The movement of the pre-exit guide will help provide a fanning or segregating distribution of the upper sheets and the upper sheets will be further stopped or held back by a stationary stopper member. The sheets near the let off device will go between the first exit guide and the pre-exit guide. As a result, the contact pressure or downward force from the weight of the sheets will be reduced and only the lower most sheet, which has contact with the let off device, will travel further through the first exit guide and the second exit guide for release.

The pre-exit guide member can be journaled in elongated slots and can be biased by a spring member to permit a limited amount of movement with a progressive increase in the force being exerted back against the upper group of transported sheets that are driven with the lowermost sheet by frictional contact. As can be determined, the cost associated with the feed rollers and the guide rollers of prior art structures can be eliminated.

The present invention can be further defined as a duplicate let off prevention device for sheets, including a first exit guide of a planar plate that cooperates with a second exit guide having an arched curved configuration shape. The first and second exit guides are positioned a distance that is larger than the thickness of one bank note and smaller than the thickness of two bank notes. A pre-exit guide member can also have an arched like curved shape and can be located adjacent the stack of bank notes in the safe. The pre-exit guide can be positioned at a first position, which is a second distance larger than the first distance, but can be forced upward against a biasing force.

A stopper member can stop the upper bank notes that are being transported by friction when the pre-exit guide moves. The pre-exit guide and the second exit guide are positioned to face the first exit guide and a sheet exit entrance section is made up between the pre-exit guide and the first exit guide and can have roughly a wedge-like cross-sectional shape. Additionally, the sheet entrance sections can also include the distance between the second exit guide and the first exit guide that further define the wedge-like shape. At the entrance section of the let off prevention device, the sheets are stopped by the pre-exit guide or the second exit guide thereby limiting the number of sheets that can travel between the first exit guide and the pre-exit guide and ultimately between the first exit guide and the second exit guide thereby minimizing the possibility of jamming of the sheets.

As the sheets above the lower most sheet become wedged between the first exit guide and the pre-exit guide, the pre-exit guide can be moved upward to a second position and a part of the upper sheets will be stopped by the stopper. The movement of the pre-exit guide will lower the contact pressure between the sheets entering into the area between the first exit guide and the second exit guide to thereby help eliminate any jamming effect. Therefore, only one sheet which has contact with the let-off device will be ultimately dispensed.

The second exit guide can have a cylindrical shape with an arc-like configuration and can be located opposite the first exit guide. The second exit guide can be made of a cylindrical configuration of a relatively inexpensive material. Thus, the present invention provides primarily a mechanical sorting configuration that will occupy a relatively small space adjacent the exit aperture of a safe, while still adequately addressing the potential problem of releasing duplicated bank notes.

DESCRIPTION OF THE PREFERRED EMBODIMENT

The following description is provided to enable any person skilled in the art to make and use the invention and sets forth the best modes contemplated by the inventors of carrying out their invention.

As used in the present invention, a sheet can encompass a rectangular piece of paper, a monetary bank note, a check, a certificate, a coupon, paper currency, scrip, or other valuable paper members with an associated cash value. As described in our preferred embodiment, bank notes are used that can be dispensed, for example, from an automatic transaction machine (ATM), gaming and vending machines, ticket dispensers, etc. The duplicated let off prevention device of the present invention can be installed in a safe unit that can be charged with a stack of bank notes and inserted into a bank note dispenser, for example, of a vending machine.

Figure 1:
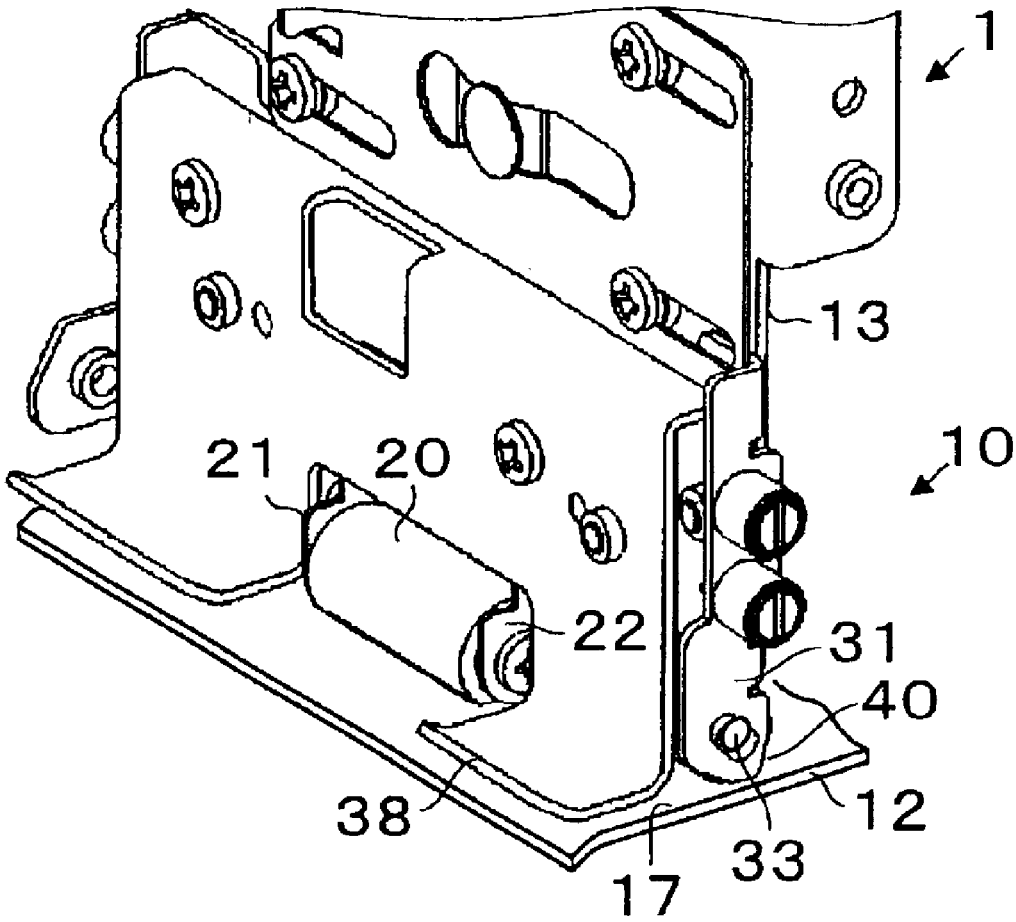
FIG. 1 is a perspective view of the bank note dispensing device for sheets of the present invention.
Figure 2:
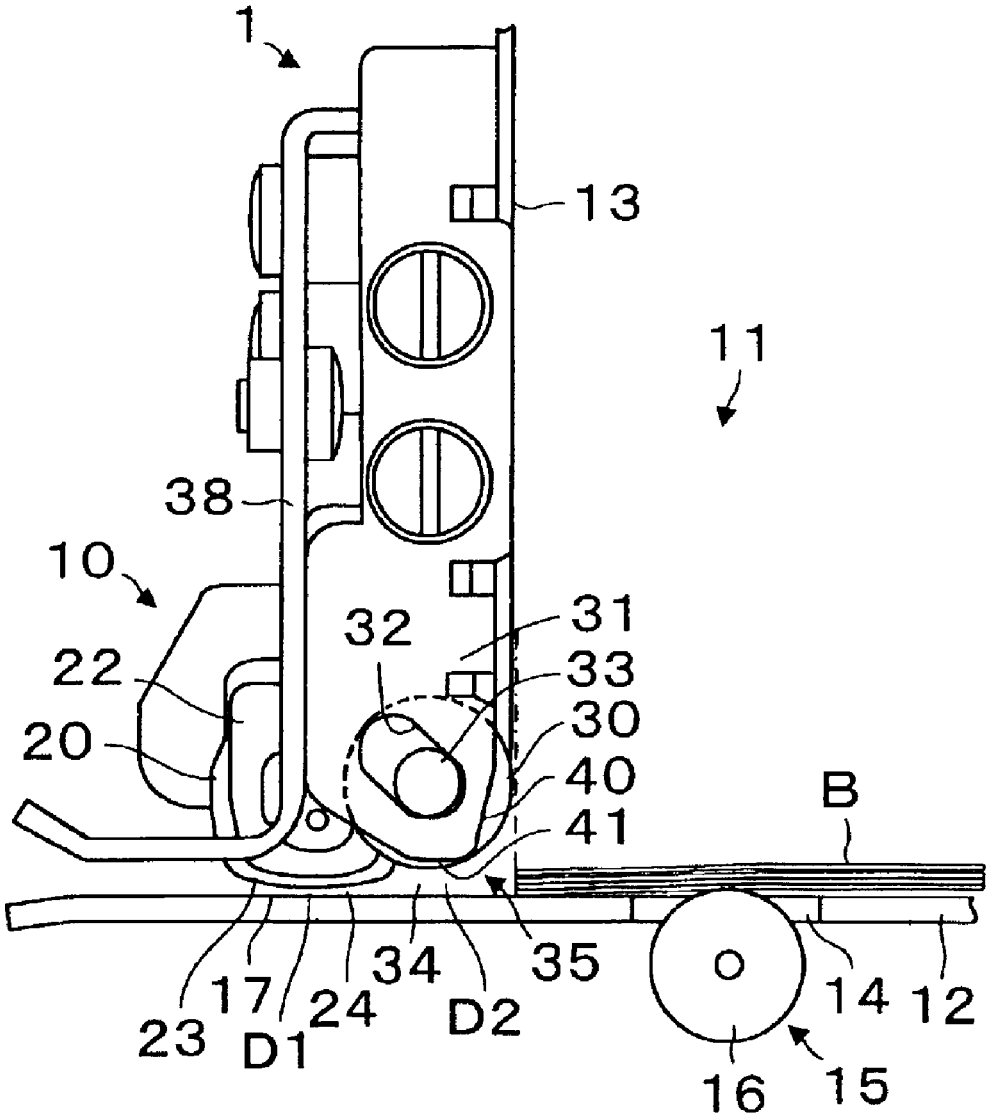
FIG. 2 is a partial side view of the bank note dispensing device.

Referring to FIG. 2, a guiding support plate or bottom board 12 extends from the storing section 11 of a safe unit and can accommodate a motor driven roller 16 of a let off device 15. The roller 16 extends through an opening 14 in the bottom board 12 so that the upper surface of the roller 16 is located in the bank note storing section 11 and can have contact with the lowest bank note. The roller 16 can advance the lowest bank note to extend beyond the first exit guide to be grasped by a pair of pinch rollers (not shown). The left end section (shown in FIG. 2) of the bottom board 12 makes up a first exit guide 17 that has a supporting planar flat surface. As shown in FIG. 2, a front wall 13 of the safe unit is disclosed to extend vertically above the bottom board 12.

A second exit guide 23 can include a rubber roller 20 of an elongated cylindrical like configuration that is positioned at a predetermined distance over the first exit guide 17. This distance will be larger than the thickness of the sheet or bank note that is to be dispensed, but smaller than the thicknesses of two bank notes. The rubber roller 20 can be fixed at the stays 21 and 22 which extend from the front wall 13. The undersurface of this rubber roller 20 forms the second exit guide 23 and can be configured into an arc-like shape that will have a larger radius than the remaining surfaces of the roller 20. Preferably, a pair of arc-like shapes are spaced to define the second exit guide member. The material of the rubber roller 20 can be of a hard urethane rubber which can be both durable and have a high friction factor.

The second exit guide member will be located a first distance D1 away from the planar first exit guide 17. The second exit guide 23 can be made up of rubber material which is readily available and can be configured to be assembled on an assembly line in an inexpensive manner. The aperture between the first exit guide 17 and the second exit guide 23 constitutes the first exit 24 from the bank note safe. As mentioned above, this first distance D1 is larger than the thickness of one sheet, and preferably smaller than the thicknesses of two sheets to thereby limit the space to accommodate only one bank note B for passing through the first exit 24.

In accomplishing the purposes of the present invention, it is desirable to have a cross-sectional wedge-like entrance section at the side of the bank note storing section 11 between the first exit guide 17 and the second exit guide 23. This configuration can be created with the assistance of a pre-exit guide 30 that is mounted in a pair of slanting elongated holes 32 located at the bracket 31. The bracket 31 protrudes from both sides of the front wall 13, although only one side is shown for illustration purposes. The slanting elongated hole 32 slants away from the bank note storing section 11 and also from the first exit guide 17. The slanting elongated holes 32 slant downwards towards the right side of FIG. 2 at roughly a 45° angle. A shaft 33 supports the pre-exit guide 30 and extends into the respective left and right elongated holes 32 and is slideable therein. The pre-exit guide 30 is cylindrical and is fixed at the middle of the shaft 33. The undersurface of the pre-exit guide 30 is positioned a distance D2 away from the first exit guide 17 and this distance helps make up a pre-exit opening 34.

Thus, the pre-exit guide 30 is located closer to the side of the bank note storing section 11 than the second exit guide 23. That portion of the pre-exit guide 30 that is to have contact with the bank notes can be configured to have an arc-like shape. This assists in providing an entrance section 35 having a cross-sectional wedge-like shape which is located at the side of the bank note storing section 11 between the first exit guide 17 and the pre-exit guide 30. The utilization of the wedge-like shape is to assist in the sorting or fanning out of the lower group of bank notes from the stacked array to facilitate a release of the lower most bank note from the upper bank notes. Thus, the second distance D2 will be larger than the first distance D1 and will have a thickness of a few bank notes.

Figure 3:
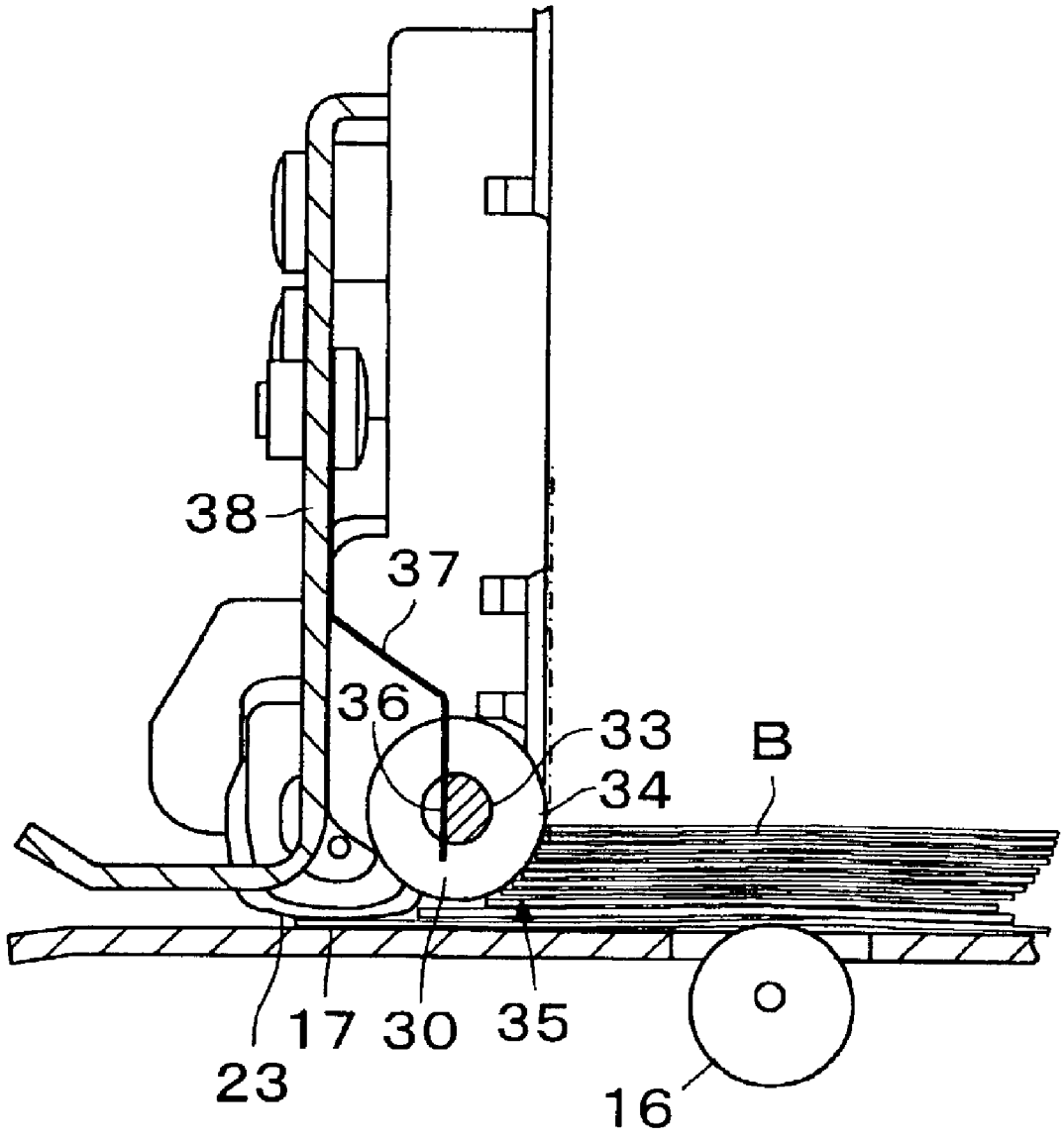
FIG. 3 is a partial cross-sectional view of the bank note dispensing device.

As seen in FIG. 3, the middle section of the shaft 33 is chamfered and is located adjacent the second exit guide 23. A resilient blade spring 37 is configured into a crank-like shape and its lower section will bear or push against a flat section 36 on the shaft 33. The upper section of the blade spring 37 will be fixed at guide 38 which is L-shaped and is also fixed at the front wall 13. In this manner, the resilient blade spring 37 is supported by one end fixed at guide 38 while the other end of the resilient blade spring 37 projects out away from guide 38 in a cantilevered fashion so that the lower section of the blade spring 37 bears against the flat section 36 on the shaft 33, as shown in FIG. 3. The shaft 33 will be biased towards the right in FIG. 3 by the cantilevered spring member 37. As a result, the end of the shaft 33 will be stopped at the lower end of the slanting elongated hole 32 to provide a normal first position. Thus, the position of the pre-exit guide 30 will be initially defined at this normal position.

Alternatively, other mechanisms can be used to bias the pre-exit guide 30 within its journaled elongated holes 32. For example, a weight member can be used instead of a cantilevered spring member 37. The purpose is to provide a predetermined force on the shaft. When the shaft is stopped by the lower section of the slanting elongated hole 32, the pre-exit guide 30 and the first exit guide 17 are maintained at the second distance D2. As can be appreciated, shaft 33 can not rotate because the flat section 36 is pushed by the blade spring 37.

The pre-exit guide 30 can be formed of an ethylene polypropylene rubber (EPDM) which can have an improved wear resistance. Alternatively, the pre-exit guide 30 can be made from a resin, such as nylon, to have even better wear resistance. If the pre-exit guide is made from a metal material, it can be formed into an arc shape. The lower section of guide 38 is bent to be parallel to the first exit guide 17 and has a larger distance than the first distance D1.

The end of the side of the bank note storing section 11 of the lower section of bracket 31 constitutes a stopper member 40 which slants with a curved surface about 15° towards the traveling direction of the bank notes. The slanted angle is at a position so that it does not separate the bank notes between the first exit guide 17 and the control surface 41. The control surface 41 of the bracket 31 is parallel to the first exit guide 17 and has a distance which is slightly longer than the second distance D2.

When the discharge roller 16 rotates in a counter-clockwise direction, the lowest bank note is moved and a series of bank notes stacked above it are also carried towards the exit side. These upper bank notes contact the pre-exit guide 30 and push it along the slanted elongated holes 32 approximately traverse to a plane containing the support surface of the first exit guide member until the stopper member 40 stops a portion of the bank notes. The stopper member 40 has a surface which is also slanted with a slanted angle between 75° to 90° to the moving direction of the bank notes.

Figure 4:
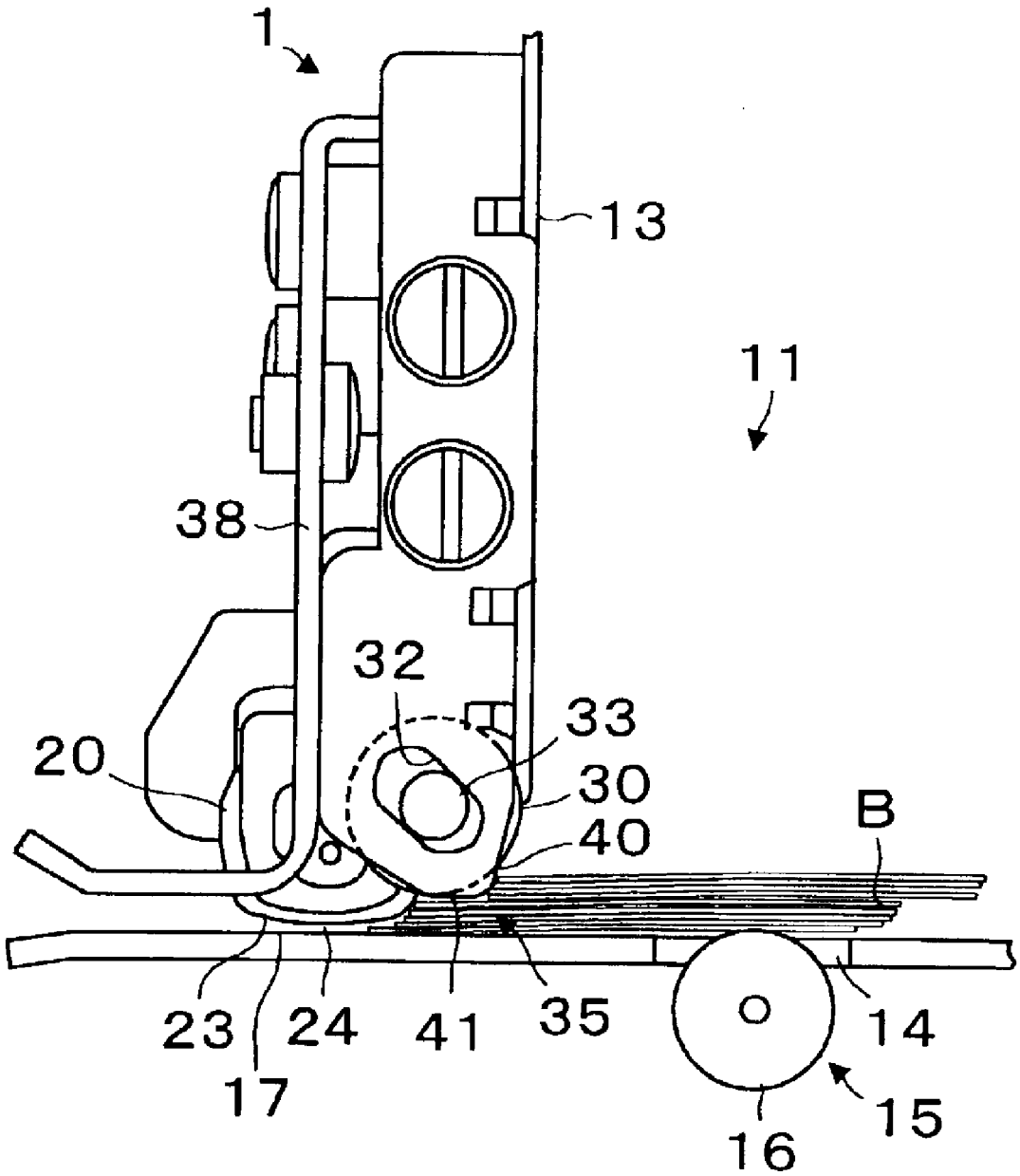
FIG. 4 is a side view of the bank note dispensing device illustrating the operation of the pre-exit guide and stopper.
Figure 5:
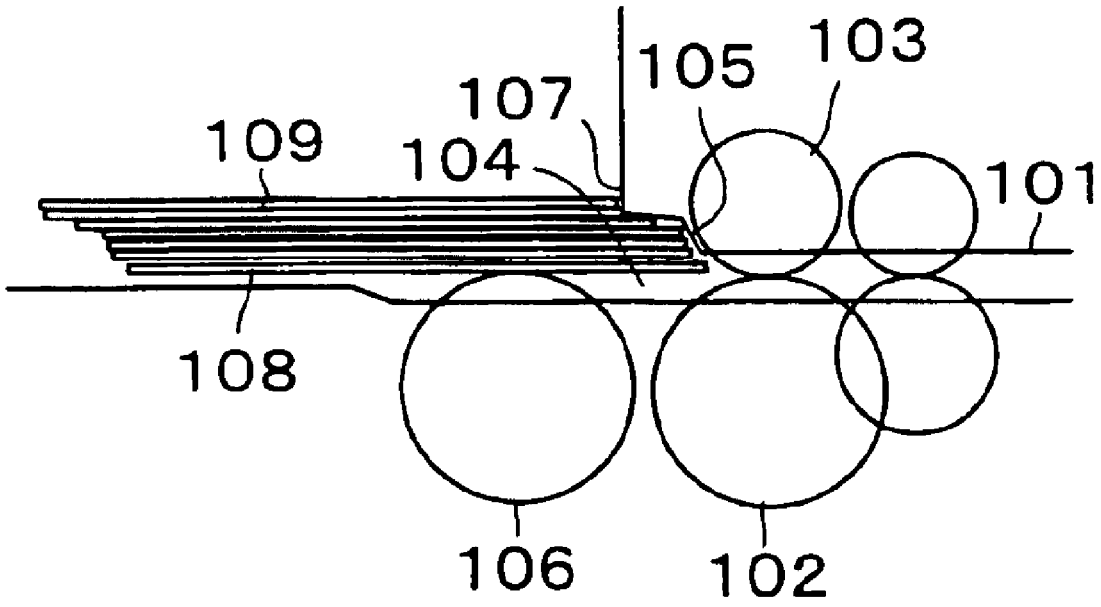
FIG. 5 is a schematic view of a prior art let off device.

Reference can be made to FIG. 4 to appreciate the operation of the present invention. When a driving motor (not shown) receives a bank note dispensing signal, roller 16 will rotate in a counter-clockwise direction to contact the lower most bank note B. The lower most bank note B will be moved to the left (shown in FIG. 4). The bank notes that are above and on top of the lowest bank note B will also be moved to the left as a result of the friction between the upper bank notes and the lowest bank note B. These upper bank notes, that are positioned on the lowest bank note B, are stopped by the arced surface of the pre-exit guide 30. Additionally, part of the upper bank notes B are also stopped by the second exit guide 23 and are further sorted because of the large curvature to the second exit guide 23. In this position, the lowest bank note B will pass through the first exit 24 and be dispensed.

If the condition of the bank notes create an abnormal situation so that a higher force is experienced, the provision of the wedged-like shape will limit the amount of force that will be applied to the lowest bank note B. The wedged-like shape will be of assistance because the radius of the arced surface of the pre-exit guide 30 will be relatively large. Increasing the radius of this arced surface of the pre-exit guide 30, however, can force a portion of the pre-exit guide 30 to extend into the safe and occupy additional room. Thus, the range of shape or radius of the pre-exit guide 30 can be limited. Alternatively, if the radius of the pre-exit guide is relatively small, the wedge effect will become larger and the bank notes B can become jammed at the section between the pre-exit guide 30 and first exit guide 17. The provision of the present configuration wherein the pre-exit guide 30 is journaled and biased to move upward to the left along the slanting elongated holes 32 as a result of the contact with the overlaying bank notes B help resolve these issues. A portion of the bank notes B will have a contact with the stopper member 40 and be stopped. The bank notes B that pass beneath the stopper member 40 will then extend between the control surface 41 and the first exit 17 (shown in FIG. 4).

Because the bank notes B, which are located between the control surface 41 and the first exit guide 17, are not subjected to a substantial wedging effect, which results because the control surface 41 and the first exit guide 17 are parallel, the friction between the bank notes will be reduced. As a result, the bank notes B are much less likely to jam and they can travel towards the first exit 24. Afterwards, a part of the bank notes B are stopped by the second exit guide 23 and therefore only the lowest bank note B will be let off from the first exit 24. Thus, the present invention provides a gradient sorting or segregation of those portions of the bank notes immediately above the lowest most bank note and performs this function in a relatively short dimensional space with mechanical components. As a result, the present invention is not only effective in achieving its results, it is relatively inexpensive and can be easily serviced and maintained.

Those skilled in the art will appreciate that various adaptations and modifications of the just-described preferred embodiment of the invention can be configured without departing from the scope and spirit of the invention. Therefore, it is to be understood that, within the scope of the appended claims, the invention may be practiced other than as specifically described herein.

What is claimed is:

1. A sheet segregating assembly for separating one sheet from a stack of sheets, comprising:

a first exit guide;

a second exit guide positioned above the first exit guide to provide an opening there between for passage of a sheet;

a pre-exit guide obliquely movable away from the stack of sheets and a plane containing a surface, the pre-exit guide is positioned before the second exit guide relative to the location for the stack of sheets, the pre-exit guide is above and biased towards a plane containing a surface of the first exit guide, to provide an opening; and a stopper member positioned adjacent the pre-exit guide to limit the horizontal movement of upper sheets, wherein horizontal movement of a plurality of sheets causes the upper sheets to contact and move the pre-exit guide away from the plane of the first exit guide and to spread the position of the upper sheets into a progressive horizontal segregation to enable a release of the lowermost sheet without a simultaneous release of an upper sheet and the pre-exit guide is journaled in elongated holes for non-rotational movement.

2. The sheet segregating assembly of claim 1, wherein the first exit guide, second exit guide, and stopper member are stationary.

3. The sheet segregating assembly of claim 1, further including a cantilevered spring member biasing the pre-exit guide.

4. The sheet segregating assembly of claim 1, wherein the pre-exit guide has a curved non-circular shape.

5. The sheet segregating assembly of claim 1, wherein the first exit guide is spaced from the second exit guide by a distance that is larger than a sheet to be dispensed and smaller than the thickness of two sheets.

6. The sheet segregating assembly of claim 1, wherein the second exit guide has an elongated cylindrical configuration of a resilient material with a pair of side non-circular curved surfaces for contacting upper sheets.

7. A sheet segregating assembly for separating one sheet from a stack of sheets, comprising:

a first exit guide;

a second exit guide positioned above the first exit guide to provide an opening there between for passage of a sheet;

a pre-exit guide movably positioned before the second exit guide relative to the location for the stack of sheets, the pre-exit guide is above and biased towards a plane containing a surface of the first exit guide, wherein horizontal movement of a plurality of sheets causes the upper sheets to contact and form the pre-exit guide away from the plane of the first exit guide and to spread the position of the upper sheets into a progressive horizontal segregation to enable a release of the lowermost sheet without a simultaneous release of an upper sheet; and a stopper member positioned adjacent the pre-exit guide to limit the horizontal movement of upper sheets, wherein the pre-exit guide is journaled in elongated holes for non-rotational movement.

8. The sheet segregating assembly of claim 7, wherein the pre-exit guide has a curved non-circular shape.

9. A sheet segregating assembly for separating one sheet from a stack of sheets, comprising:

a first exit guide;

a second exit guide positioned above the first exit guide to provide an opening there between for passage of a sheet;

a pre-exit guide movably positioned before the second exit guide relative to the location for the stack of sheets, the pre-exit guide is above and biased towards a plane containing a surface of the first exit guide, wherein horizontal movement of a plurality of sheets causes the upper sheets to contact and form the pre-exit guide away from the plane of the first exit guide and to spread the position of the upper sheets into a progressive horizontal segregation to enable a release of the lowermost sheet without a simultaneous release of an upper sheet; and a stopper member positioned adjacent the pre-exit guide to limit the horizontal movement of upper sheets, wherein the second exit guide has an elongated cylindrical configuration of a resilient material with a pair of side non-circular curved surfaces for contacting upper sheets.

10. A sheet segregating assembly for separating one sheet from a stack of sheets, comprising:

a first exit guide;

a second exit guide positioned above the first exit guide to provide an opening there between for passage of a sheet, wherein the second exit guide has an elongated cylindrical configuration of a resilient material with a pair of side non-circular surfaces for contacting upper sheets;

a pre-exit guide obliquely movable away from the stack of sheets and a plane containing a surface, the pre-exit guide is positioned before the second exit guide relative to the location for the stack of sheets, the pre-exit guide is above and biased towards a plane containing a surface of the first exit guide, to provide an opening; and a stopper member positioned adjacent the pre-exit guide to limit the horizontal movement of upper sheets, wherein horizontal movement of a plurality of sheets causes the upper sheets to contact and move the pre-exit guide away from the plane of the first exit guide and to spread the position of the upper sheets into a progressive horizontal segregation to enable a release of the lowermost sheet without a simultaneous release of an upper sheet.

* * * * *